US005765748A

United States Patent [19]

Chen

[11] Patent Number: 5,765,748

[45] Date of Patent: Jun. 16, 1998

[54] BOX COVER

[76] Inventor: In-Chang Chen, 938 W. 22nd St., Upland, Calif. 91786

[21] Appl. No.: 622,627

[22] Filed: Mar. 27, 1996

[51] Int. Cl.[6] ..... C65D 5/42; C65D 5/68

[52] U.S. Cl. ..... 229/125.22; 229/125.38; 229/198.1; 229/198.3

[58] Field of Search ..... 229/125.21, 125.22, 229/125.23, 198.1, 198.2, 198.3, 165, 166, 125.38; 220/7, 640, 642, 692, 666; 383/72, 73, 74, 75, 76

[56] References Cited

U.S. PATENT DOCUMENTS

| | | | |
|---|---|---|---|
| 191,712 | 6/1877 | Pickens | 229/198.1 X |
| 343,757 | 6/1886 | Cole | 229/198.1 |
| 1,019,471 | 3/1912 | Herman | 229/125.21 |
| 1,271,542 | 7/1918 | Crenshaw | 229/125.22 |
| 1,725,526 | 8/1929 | Kondolf | 229/125.22 |
| 1,725,527 | 8/1929 | Kondolf | 229/125.22 |
| 2,410,148 | 10/1946 | Buhrmaster | 229/125.21 |
| 2,512,522 | 6/1950 | Denny | 220/7 X |
| 2,552,443 | 5/1951 | Molinari | 383/72 X |
| 2,646,914 | 7/1953 | Claff et al. | 229/198.1 X |
| 3,370,779 | 2/1968 | Cole | 229/125.22 |
| 3,394,868 | 7/1968 | Speer | 229/125.22 |
| 3,901,432 | 8/1975 | Lancaster | 229/125.22 |
| 3,949,933 | 4/1976 | Giambrone et al. | 229/198.1 X |
| 4,694,986 | 9/1987 | Chou | 229/198.1 X |
| 5,092,681 | 3/1992 | Ashley, III | 383/4 |
| 5,133,607 | 7/1992 | Bonke | 383/75 |
| 5,156,328 | 10/1992 | Wozniacki | 229/125.22 |
| 5,322,213 | 6/1994 | Carter et al. | 229/166 |
| 5,482,374 | 1/1996 | Buhyoff | 383/75 X |
| 5,518,313 | 5/1996 | McAdam | 383/75 X |
| 5,529,395 | 6/1996 | French | 383/75 |

FOREIGN PATENT DOCUMENTS

| | | | |
|---|---|---|---|
| 685799 | 3/1965 | Italy | 220/7 |
| 307503 | 8/1955 | Switzerland | 229/198.1 |

*Primary Examiner*—Gary E. Elkins
*Attorney, Agent, or Firm*—Bacon & Thomas

[57] ABSTRACT

A box cover having a cover plate, multiple side plates, a fixing device, at least one fixing string, and optionally multiple fold lines for the convenience of assembly of the box cover. The side plates are installed on the periphery of the cover plate and the number of side plates varies according to the geometry of the cover plate. At least one fixing string is located along the side plate and the fixing device is used to fix the fixing string on the side plate in an encircling manner in which the fixing string can move freely in the axial direction. To assemble the box cover, the user need only pull the fixing string outward to tighten the fixing string such that the planar box cover becomes a three dimensional box cover.

7 Claims, 11 Drawing Sheets

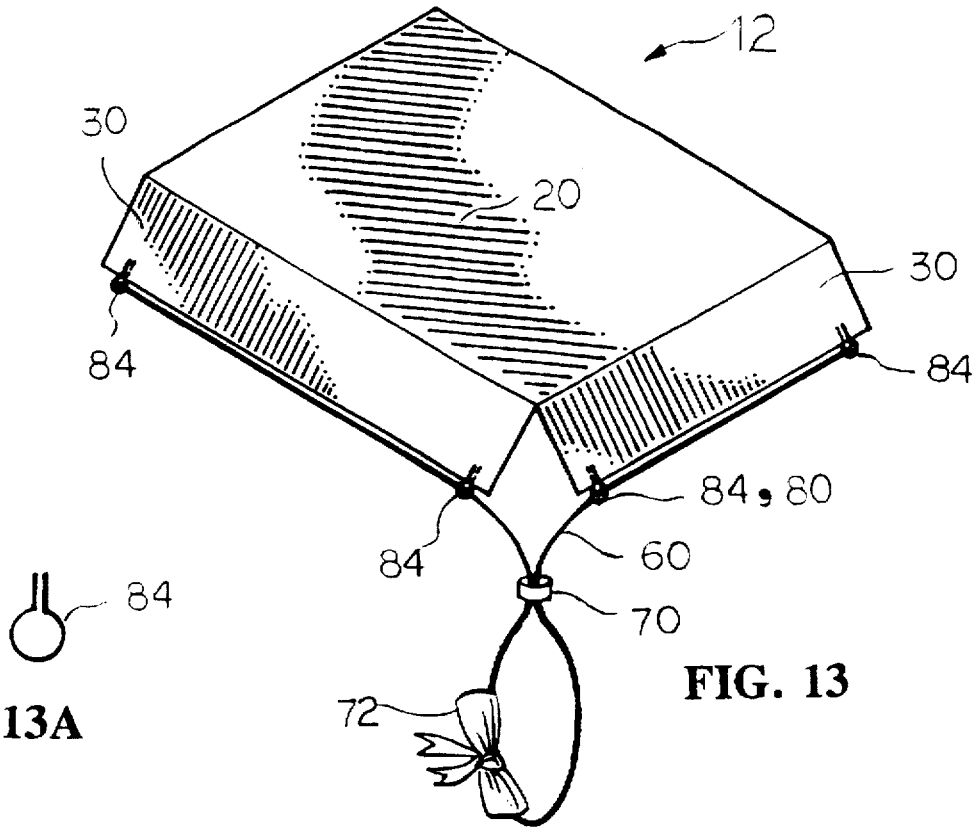
FIG. 13
FIG. 13A
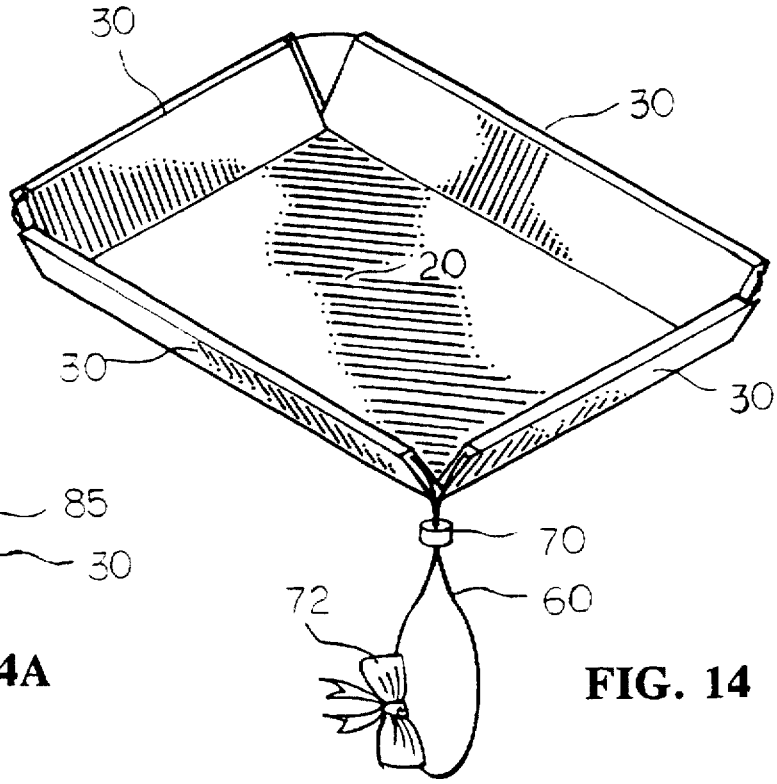
FIG. 14
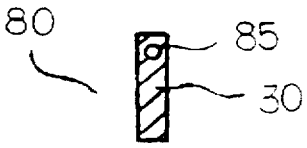
FIG. 14A

BOX COVER

BACKGROUND OF THE INVENTION

In the past, the structure of ordinary box cover comprises a cover plate and multiple side plates on the surrounding of the cover plate. During production of the box cover, an integral formation means will be adopted to cut or press the plates, such as paperboards, plastic plates, etc., into planar and un-assembled box covers. During the production process, for the convenience of future assembly, the fold lines are usually prepared by cutting or pressing at the same time.

For a box cover with simplest construction, the assembly of a box cover requires folding the side plates followed by appropriate adhesion treatment so that the side plate and the cover plate forms a certain angle (90 degrees, as a rule). Since this type of conventional box cover is well known among the people who are skilled in the art, its detailed structure will not be elaborated further in the present invention.

At the present, there are a wide varieties of improved box covers or boxes in which their design improvements focuses on changing the geometry of side plate, or increasing the number of auxiliary plates, or cutting scoop channels at appropriate locations on the cover plate and the side plate; so that the planar box cover can be assembled into tridimensional box cover through folding by the user without the necessity of using adhesion means to maintain the box cover at the tridimensional geometry. Since the scope of the present invention is not focused on changing the tridimensional geometry of the side plate, the structures of the improved box covers or boxes will not be elaborated further in the present invention.

During assembly of the conventional box covers, the user requires to spend a lot of time and carry out complicate folding operations in order to assemble the planar box cover into tridimensional box cover. Therefore, users such as shop assistants of gift shops, stationery shops, patisseries, etc., often prepare the box covers into tridimensional box covers in advance in order to be time efficient during busy hours. However, pre-assembled tridimensional box covers take up plenty of storage space and affect the picture of store.

SUMMARY OF THE INVENTION

The box cover of the present invention mainly comprises a cover plate, multiple side plates, a fixing device, at least one fixing string, and optionally multiple fold lines for the convenience of assembly of the box cover; in which the cover plate can be of any geometry such as triangular, quadrangular or polygon and the side plates are installed on the periphery of the cover plate and the number of side plates varies according to the geometry of the cover plate.

One of the main characteristics of the box cover of the present invention is that the box cover comprises at least one fixing string in which the preferable placement position of the fixing string is located along the side plate and the fixing device is used to fix the fixing string on the side plate to form a encircling status in which the fixing string can move freely in the axial direction. The fixing string can be endless circular string or an ordinary long string with two ends and the fixing string can be made of elastic or inelastic material. Furthermore, the outlet of the fixing string is preferably located on the adjoining line of two side plates.

While assembling the box cover, the user only requires to pull the fixing string outward to tighten the fixing string such that the planar box cover becomes a tridimensional box cover. Subsequently, while assembling the box, the tridimensional box cover matches with another box cover during which the fixing string can be used to fix another box cover to complete the operation of box assembly.

BENEFITS OF THE INVENTION

The present invention is related to a design of box cover (such as upper box cover or lower box cover), in particular a box cover which will allow the user to promptly assemble the planar box cover into tridimensional box cover through pulling tight the fixing string. As a result, the box cover of the present invention is planar during storage and does not take up much space; while in use, the shop assistants of gift shops, stationery shops, patisseries, etc., can assemble the box cover in situ to achieve maximum efficiency in time saving and space. Furthermore, the box cover of the present invention is attached with a fixing string which, during its combination with other box cover, provides another application, i.e. the user can utilize the fixing string to tighten another box cover combined therewith to promptly form a tightened box without the need of using another string to combine the two box covers. In other word, the worker or user will no longer require to use separate string or tape in order to tighten the box.

Since conventionally strings or tapes are used to tighten the upper and lower box covers, elaborate means will be needed to unfold the box covers. The knots are often difficult to untie and tearing of adhesive tapes often causes damages on the box cover. By using the box cover of the present invention, the presentee can easily unfold the box cover without going through the difficulties of untying the string or tearing the adhesive tape and damaging the picture of the box surface.

If necessary, the embellishment(s) can be preassembled with the fixing string on appropriate location(s) so that the user can assemble the box cover with another box cover through continuous operations and complete tightening the box attached with embellishment(s). The invented structure and its operation can greatly reduce the operation time of the user.

Similarly, during disassembly of the assembled box cover or box, the reverse procedures can be used to unfold the tridimensional box cover into a planar box cover.

BRIEF DESCRIPTION OF THE DRAWINGS

FIG. 2-A. Enlarged top view of the assembled box cover of Example 2.

FIG. 5-A. Enlarged view of cross-section 1—1 of FIG. 5 according to Example 1.

FIG. 11-A. Pictorial drawing of hollow tubular element of Example 5 of the present invention.

FIG. 11-B. Enlarged view of cross-section 11—11 of FIG. 11 of FIG. 11.

FIG. 13. Pictorial drawing of Example 7 box cover of the present invention.

FIG. 13-A. Front view of buckle element of Example 7 box cover of the present invention.

FIG. 14. Pictorial drawing of Example 8 box cover of the present invention.

FIG. 14-A. Enlarged view of the cross-section of side plate of Example 8 of the present invention.

REFERENCE NUMERALS IN DRAWINGS

Figure 1:
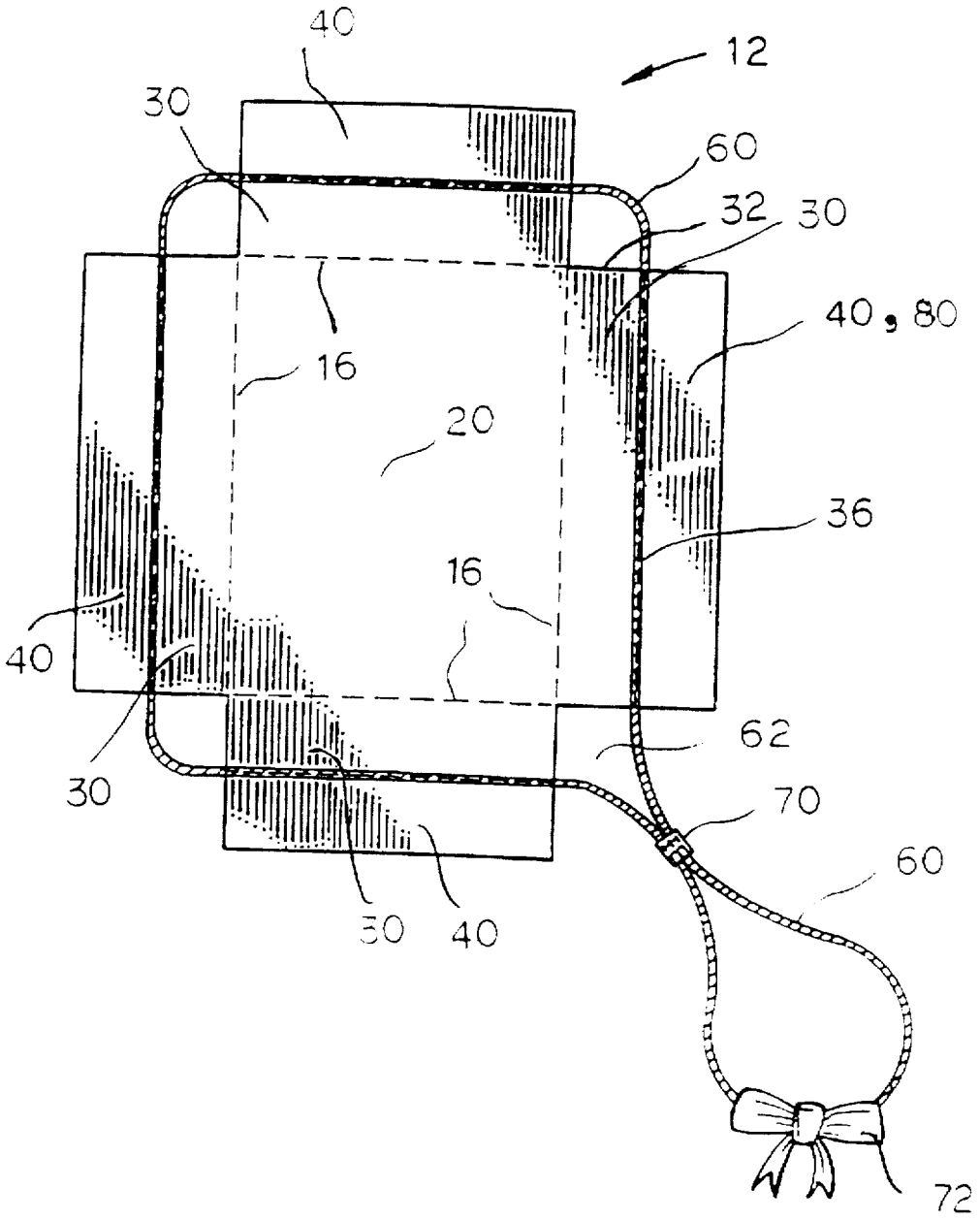
FIG. 1. Developed plane view drawing of Example 1 of the box cover of the present invention.

| | |
|---|---|
| Box 10 | Box cover 12 |
| Second box cover 14 | Fold line 16 |
| Cover plate 20 | Side plate 30 |
| Width of side plate 32 | Length of side plate 34 |
| Adhesion area 35 | Outer edge of side plate 36 |
| Attachment plate of side plate 40 | Width of attachment plate of side plate 42 |
| Length of attachment plate of side plate 44 | Outer edge of attachment plate of side plate 46 |
| Indent 45 | Auxiliary attachment plate 50 |
| Width of auxiliary attachment plate 52 | Length of auxiliary attachment plate 54 |
| Fixing string 60 | Outlet point 62 |
| Retainer ring 70 | Embellishment 72 |
| Fixing device 80 | Hollow tube 81 |
| Scoop channel 82 | Hook 83 |
| Buckle 84 | Through channel 85 |

DETAILED DESCRIPTION OF THE PREFERRED EMBODIMENTS

FIG. 1 is the developed plane view drawing of Example 1 of the box cover 12 of the present invention. The box cover 12 mainly comprises rectangular cover plate 20, side plate 30, attachment plate 40 of side plate and at least one fixing string 60. The attachment plate 40 of side plate of this example is used to fix the fixing string 60 at appropriate position on the fixing device 80. Besides the fixing string 60, the box cover 12 can be directly punching from paper board to form the desired fold lines 16 (as indicated by dot lines in the Figure). The cover plate 20, the side plate 30, the attachment plate 40 of the side plate are divided by the fold lines 16 and can be formed integrally. Although the fold lines 16 are not mandatory, they are beneficial in the assembly of the box cover 12. Since the cover plate 20 of the present invention is rectangular, the four side plates 30 are correspondingly installed on four sides of the cover plate 20. Each side plate 30 can be bent corresponding to the cover plate 20 in order to change from a state of on the same plane with the cover plate 20 to a state of on a different plane with the cover plate 20. Furthermore, each side plate 30 is connected to the attachment plate 40 of the side plate at the outer edge 36 of the side plate. As a matter of fact, the cover plate 20, in any of the examples, can be triangular, quadrangular, or even multilateral, or circular (oval); and the number of side plate 30 and attachment plate 40 of side plate depends on the geometry of the cover plate 20.

The length of each side plate 30 can be equal to the perimeter of the corresponding cover plate 20. The length of attachment plate 40 of side plate can be equal to the length of corresponding side plate 30, as in Examples 1 to 3; however, optionally an indent 45 can be created on the edge of certain attachment plate 40 of side plate, i.e. the length of attachment plate 40 of side plate can be smaller than the length of corresponding side plate 30. The effectiveness of the indent 45 shall be elaborated further in Example 2.

Figure 2:
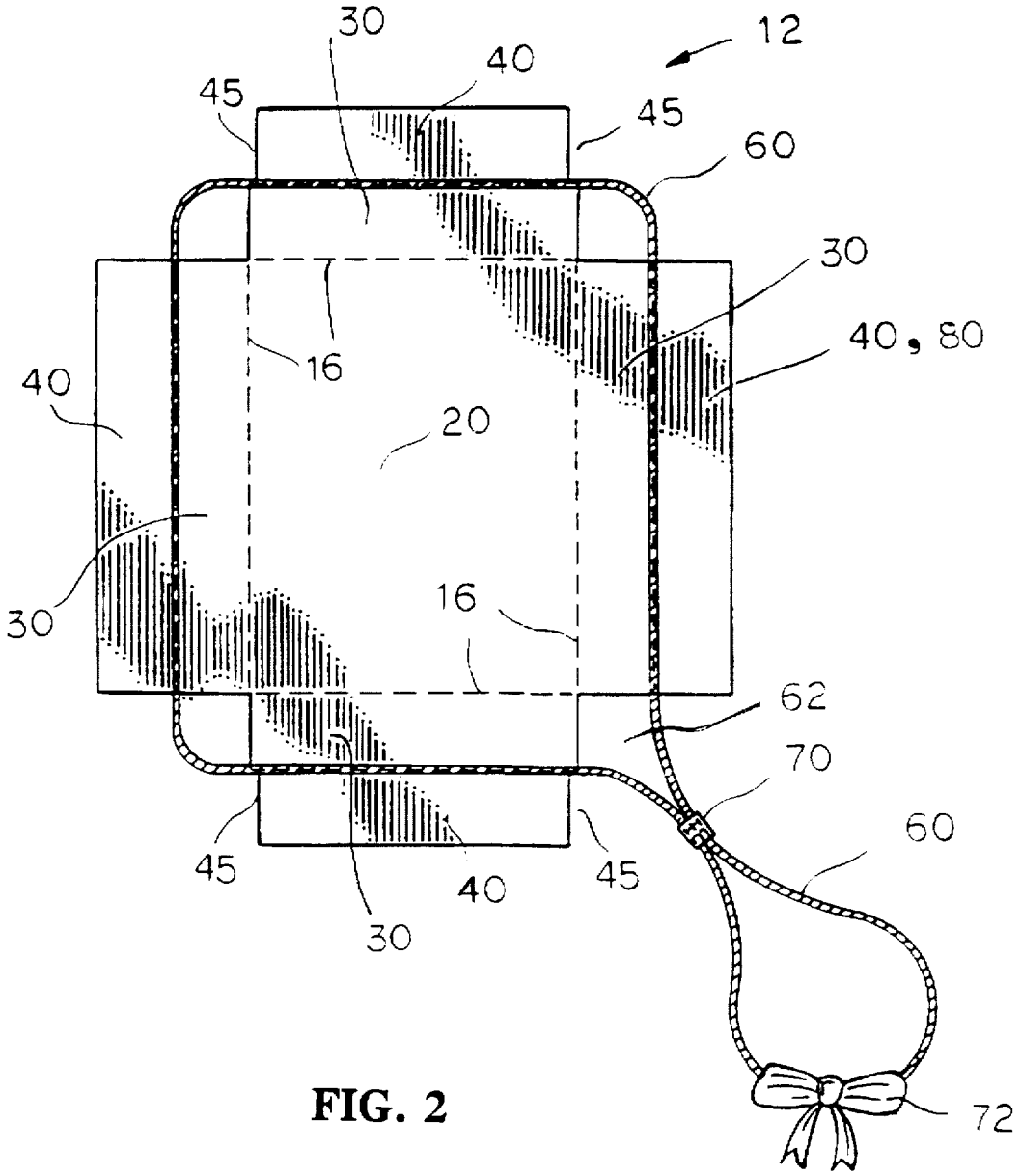
FIG. 2. Developed plane view drawing of Example 2 of the box cover of the present invention.
Figure 2A:
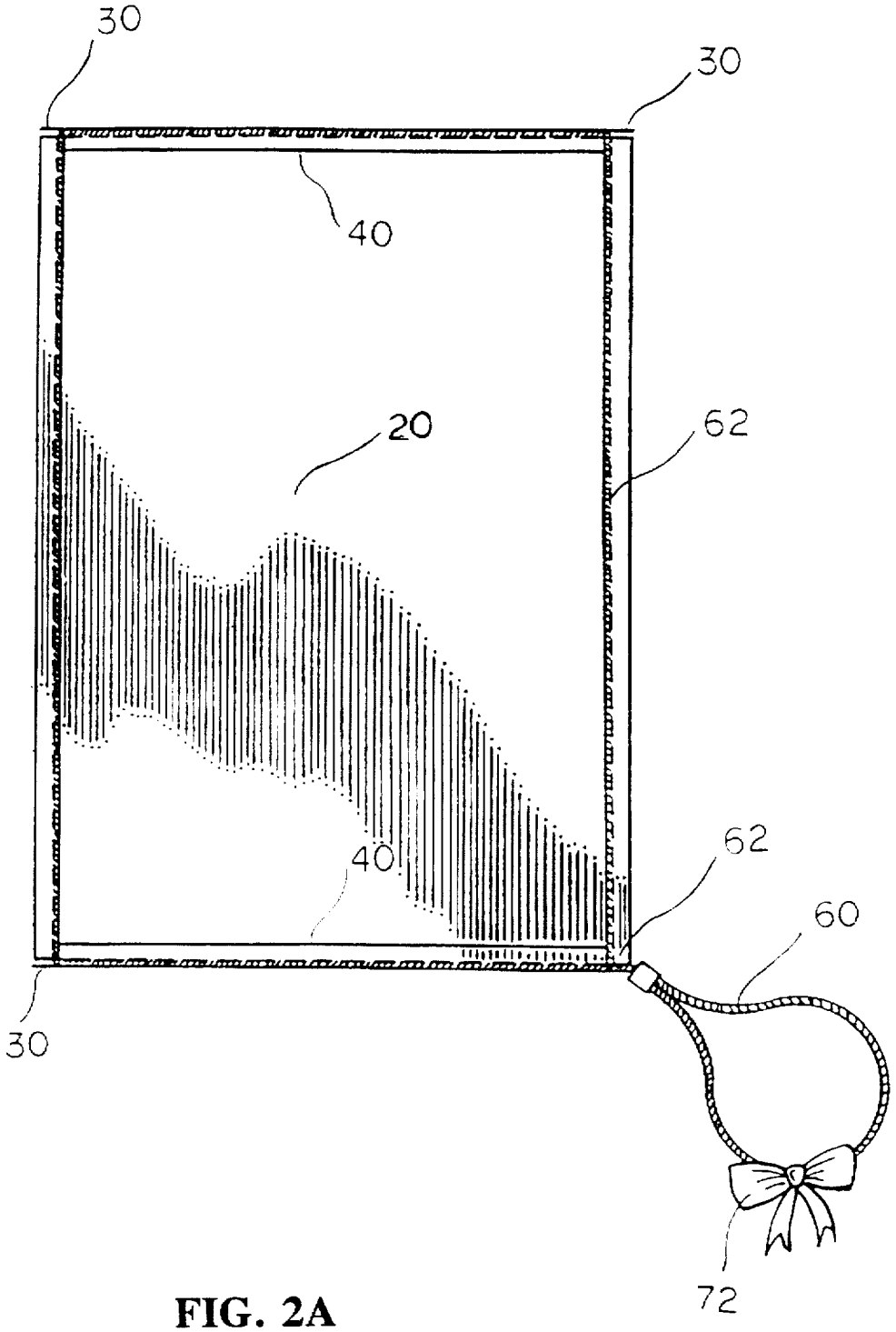
Figure 3:
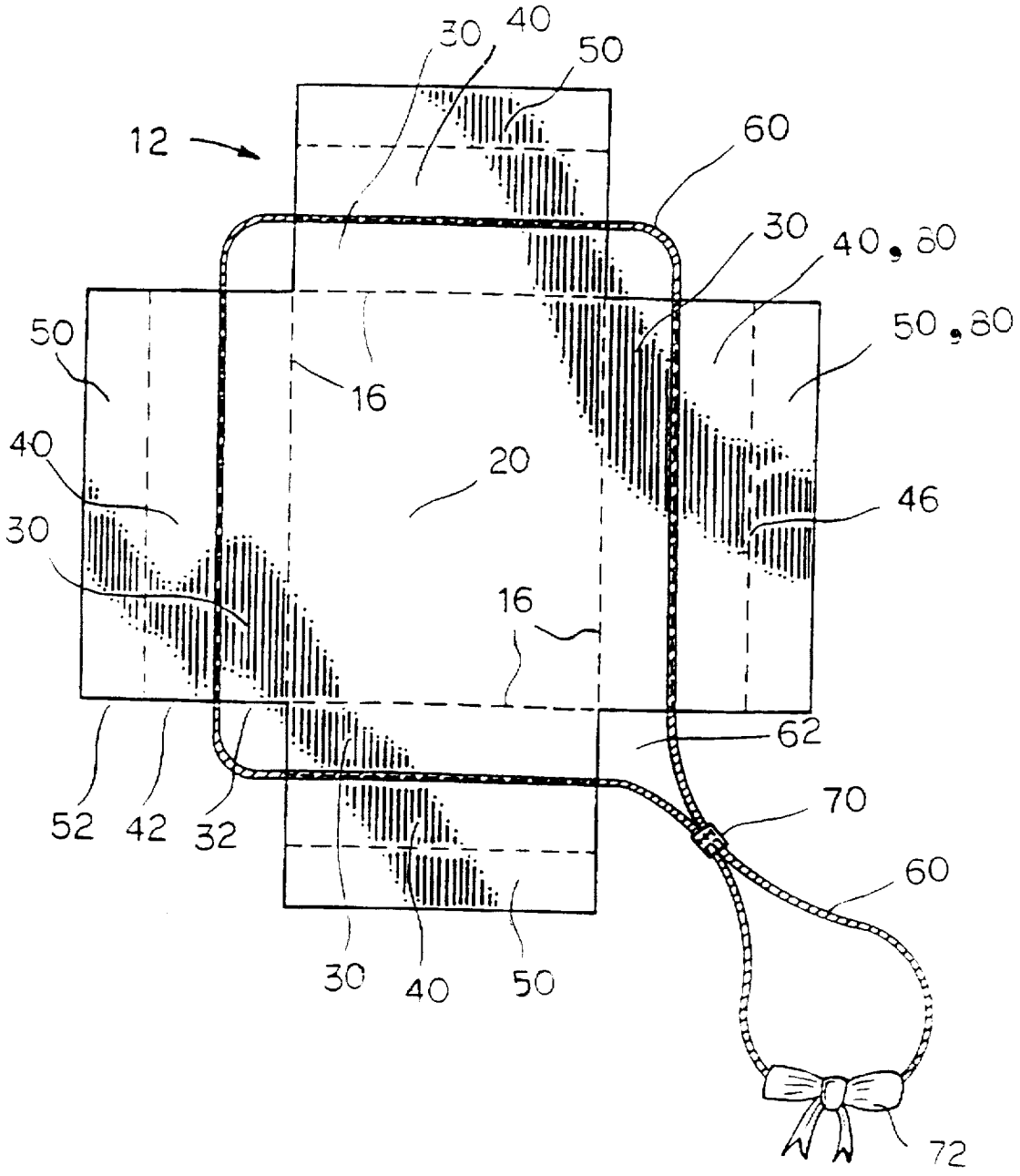
FIG. 3. Developed plane view drawing of Example 3 of the box cover of the present invention.
Figure 4:
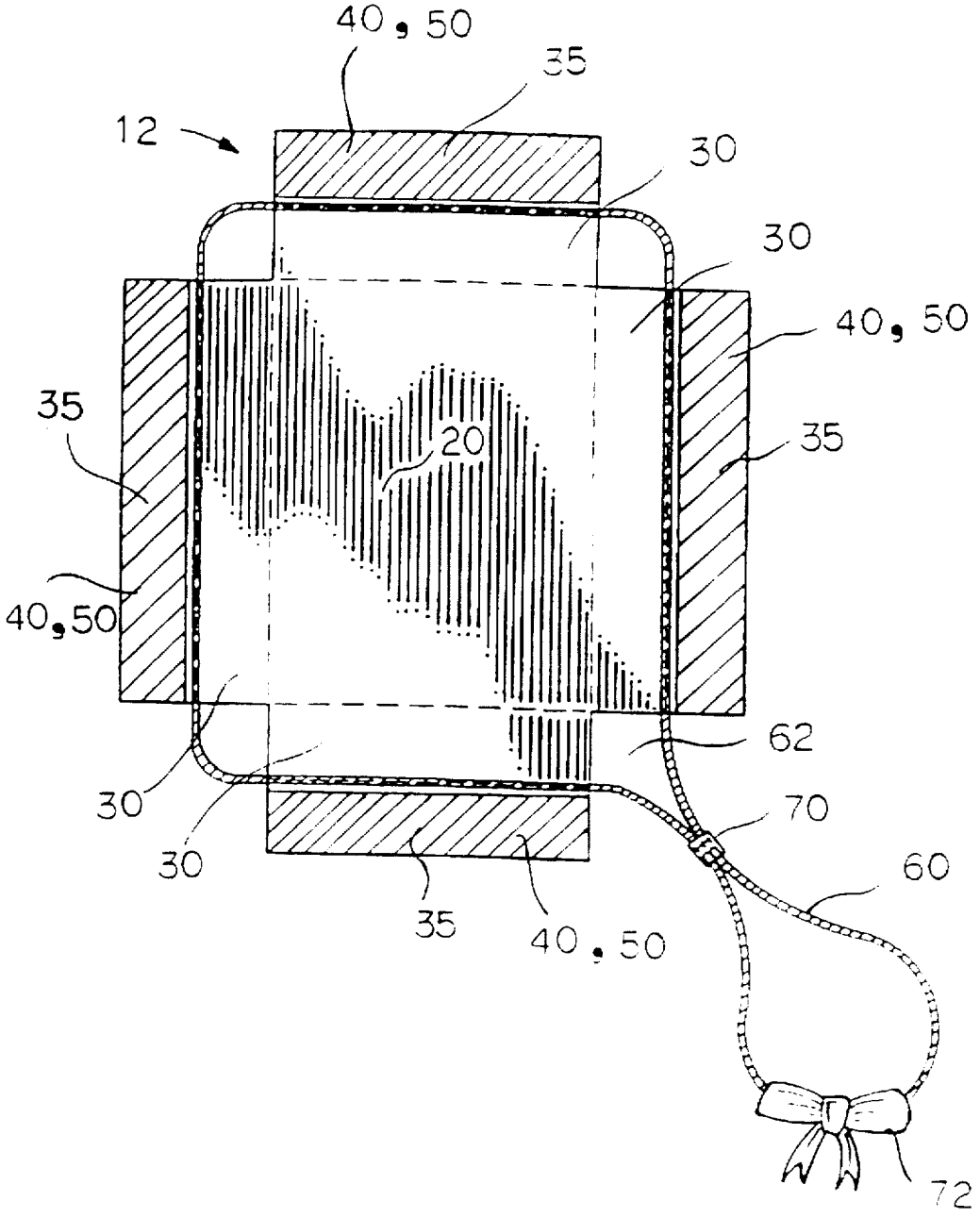
FIG. 4. Plane view of the combined side plate and the attachment plate of side plate of Example 1 of the present invention; and the plane view of the combined side plate, attachment plate of side plate, and auxiliary attachment plate of Example 3 of the present invention.

Another characteristic of the box cover 12 of the present invention is that the box cover 12 comprises at least one fixing string 60. The preferable placement positions of the fixing string 60 are shown in FIGS. 1 to 3. The fixing string can be placed along the fold line between the side plate 30 and the attachment plate 40 of side plate (i.e., the outer edge 36 of side plate) to form an encompassing state. The fixing string 60 can be an endless circular string (which also can be formed by tying long strings into endless circular string) or an ordinary long string with two ends (not shown in the Figures). The material of the fixing string can be elastic (e.g., elastic string) or inelastic. The length of the fixing string 60 shall depend on its material, the size of box cover 12 and the second box cover 14, and its use. The outlet point 62 of the fixing string 60 is preferably located at the adjacent place of the two side plates 30. If the outlet point 62 of the fixing string 60 is not located at the adjacent place of the two side plates 30, a small opening shall be installed on the side plate 30 or/and the attachment plate 40 of the side plate to serve as the outlet point 62 of the fixing string 60.

As shown in FIGS. 1 to 4, during preparation of the box cover 12 of the present invention, as described herein before, the fixing string 60 can be placed at an appropriate position; and the attachment plate 40 of the side plate be folded toward the side plate 30 to envelop the fixing string 60 in which the attachment plate 40 of the side plate and the side plate 30 can be bonded together by an adhesive to envelop the fixing string 60. The bonding position is indicated by the slants shown in FIG. 4. Of course, equivalent means can be adopted to fix the attachment plate 40 of the side plate and the side plate 30. Furthermore, for the purpose of picture and more precisely enveloping the fixing string 60, the fold line between the attachment plate 40 of the side plate and the side plate 30 can be double fold lines (not shown in the Figures); i.e., the width between the double fold lines can accommodate the thickness of the fixing string 60. However, notes shall be taken to ensure that the fixing string 60 is capable of being moved freely in spite of being enveloped; i.e., when the attachment plate 40 of the side plate and the side plate 30 envelop the fixing string 60, the longitudinal (the axial direction in length of the fixing string) movement (refer to FIG. 5-A) of the fixing string 60 is not limited so that during assembly of the box cover 12 the user can pull tight the fixing string 60. The attachment plate 40 of the side plate also has the function of reinforcing the side plate 30; and the minimum width of the attachment plate 40 of the side plate shall be able to envelop the fixing string 60. Furthermore, the fixing string 60 may not be placed in the appropriate position in advance; rather that after fixation of the attachment plate 40 of the side plate and the side plate, the fixing string 60 can then be introduced into the reserved space and achieve the same result of enveloping the fixing string 60.

Figure 5:
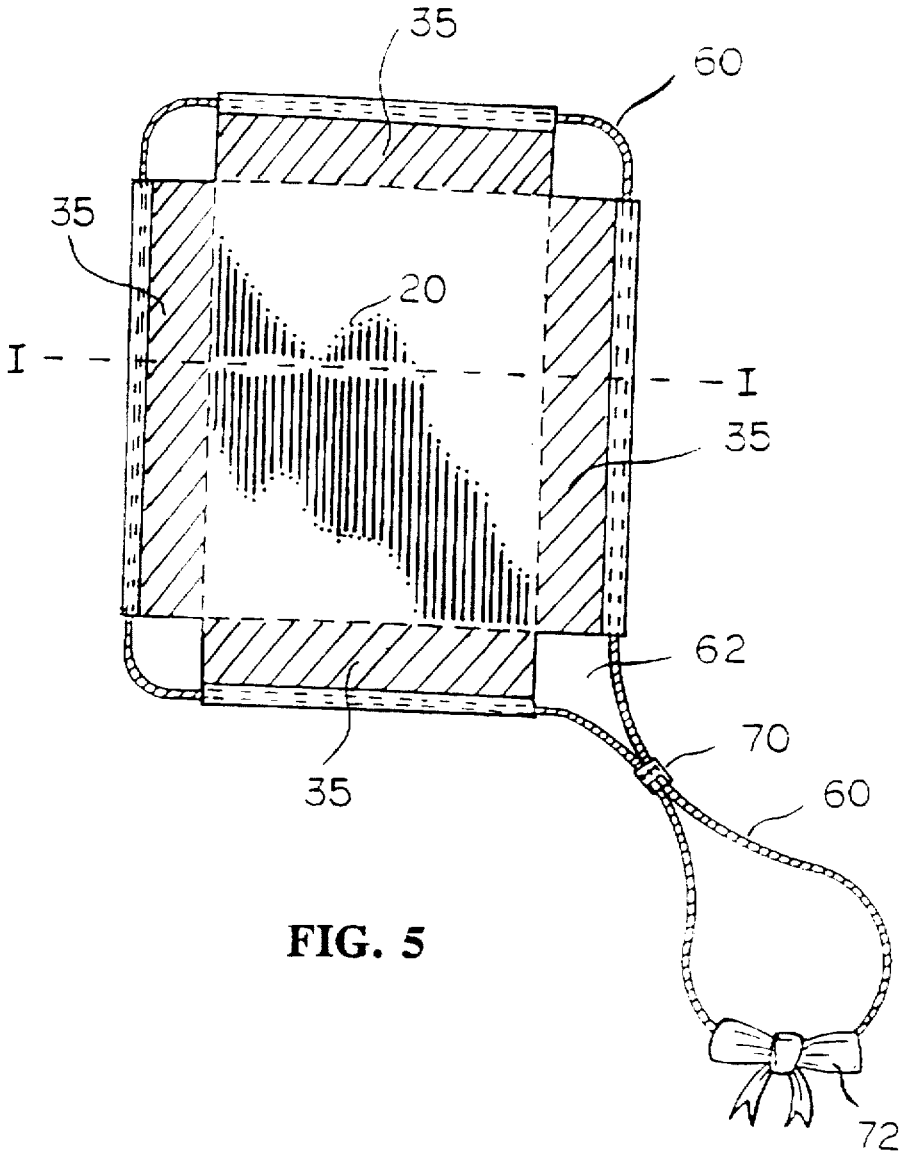
FIG. 5. Plane view of the combined attachment plate of side plate and auxiliary attachment plate of Example 3 of the present invention.
Figure 5A:
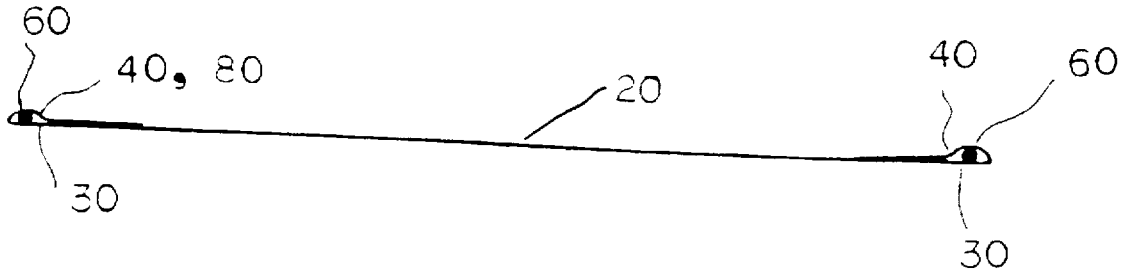

Furthermore, please refer to the developed plane view drawing of Example 3 of the box cover of the present invention, as shown in FIG. 3, in which the box cover 12, same as Example 1, mainly comprises rectangular cover plate 20, side plate 30, attachment plate 40 of side plate and at least one fixing string 60. However, the outer edge 46 of each attachment plate 40 of side plate is further installed with an auxiliary attachment plate 50 in which the length of the auxiliary attachment plate is preferably equal to the length of the attachment plate 40 of the side plate and the width 52 of the auxiliary attachment plate is preferably smaller than the width 42 of the attachment plate 40 of the side plate. The main functions of the auxiliary attachment plate 50 include providing reinforcement to the strength of the side plate 30 and extra space to the fixing string 60. Please refer to FIG. 5 for further understanding of the functions of the auxiliary attachment plate 50. As shown in FIG. 5, the auxiliary plate 50, after folding, is connected to the attachment plate 40 of the side plate. However, preferably an adhesive or other equivalent means shall be used to combine the folded auxiliary attachment plate 50 and the attachment plate 40 of the side plate together. When the width 52 of the auxiliary attachment plate is smaller than the width 42 of the attachment plate of the side plate (i.e., as shown in FIG. 5), the combined attachment plate 40 of the side plate and the auxiliary attachment plate 50, after folded further toward the side plate 30, can be represented by FIG. 4. Since the bonded area 35 has an extra thickness of the auxiliary attachment plate 50 than Example 1, it reinforces the strength of the side plate 30 and provides larger space for the fixing string 60 to be placed between the side plate 30 and the attachment plate 40 of the side plate. If the width 52 of the auxiliary attachment plate is equal to the width 42 of the attachment plate of the side plate, the auxiliary attachment plate 50 only reinforces the strength of the side plate 30. Of course, each attachment plate 40 of side plate can be equipped with one or more auxiliary attachment plate 50 to reinforce the strength of the side plate 30 and the space occupied by the fixing string 60. In this Example, the attachment plate 40 of the side plate and the auxiliary attachment plate 50 are the fixing device 80 used to fix the fixing string 60 at appropriate position.

Figure 7:
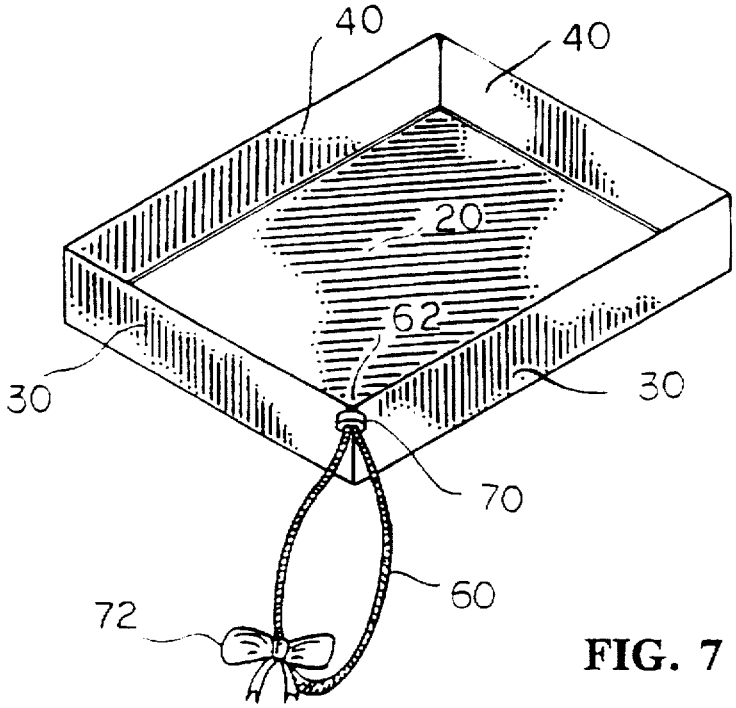
FIG. 7. Pictorial drawing of assembled tridimensional box cover of the present invention.

As shown in Example 2 of FIG. 2, optionally an indent 45 can be created at certain edge of the attachment plate 40 of side plate; i.e., the length of the attachment plate of side plate can be smaller than the length of corresponding side plate. Preferably, an edge of the attachment plate 40 of side plate selected from the two adjacent attachment plates 40 of side plate shall be used to prepare the indent 45. The case of Example 2 is an optional means. And the size of the indent 45 shall depend on the thickness of the bottom of box cover 12 formed by the fixing string 60 which is enveloped by the side plate 30 and the attachment plate 40 of the side plate after assembly of the box cover 12 (as shown in FIG. 7). The FIG. 2-A is the enlarged top view of Example 2 after assembly. The function of the indent 45 is to provide tight sealing on the periphery of the box cover 12 after assembly of the box cover 12.

The three Examples mentioned herein before share the same basic concepts. However, elements other than the cover plate 20, such as side plate 30, attachment plate 40 of side plate, and auxiliary attachment plate 50, have difference in design. And the differences can be applied on different examples to further form different embodiments. For example, the indent 45 design of Example 2 can be applied on Example 3 so that the auxiliary attachment plate 50 of Example also has the design of indent 45.

The fixing device 80 used to fix the fixing string 60 of Examples 4 to 8 is different from the fixing means of Examples 1 to 3; i.e., the fixing device is not an attachment plate 40 of side plate or an auxiliary attachment plate 50.

Figure 10:
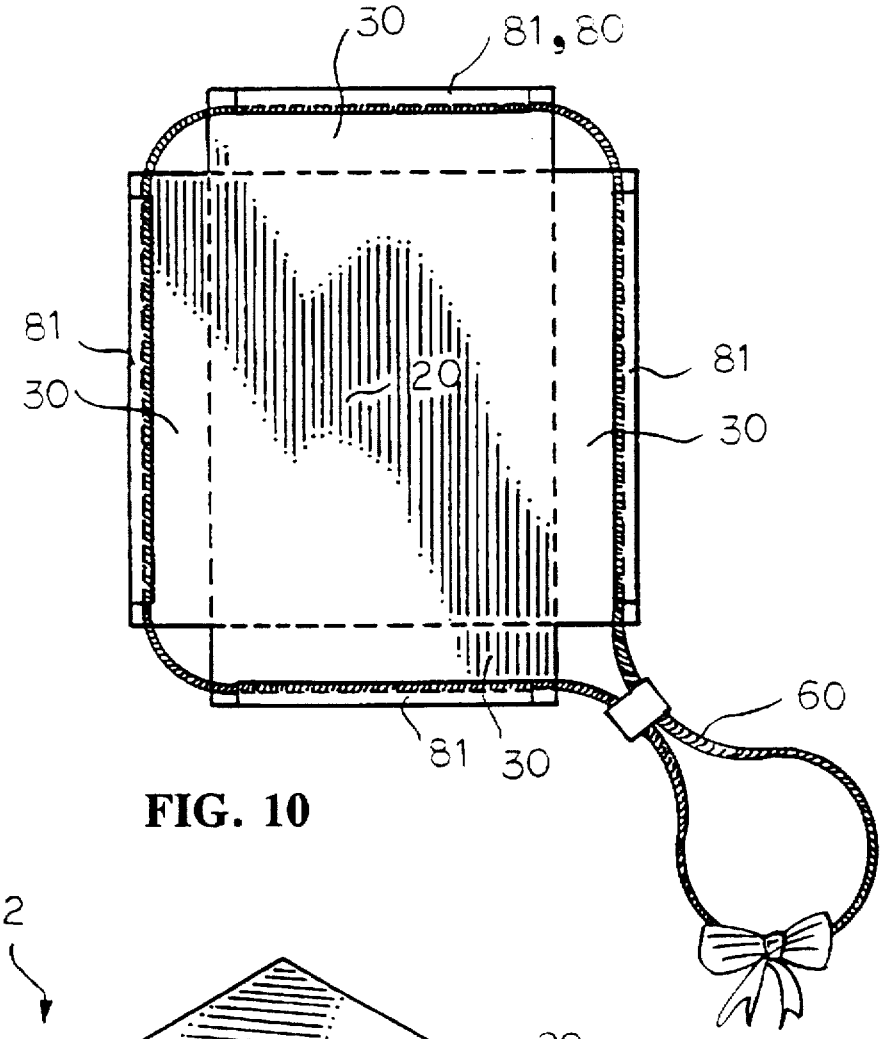
FIG. 10. Developed plane view drawing of Example 4 of the box cover of the present invention.

As shown in FIG. 10, the fixing device 80 in Example 4 of the box cover of the present invention is a hollow tube 81. Hollow tubes are separately installed on the outer edge 36 of each side plate 30 in which the hollow tubes can be fixed on the side plate 30 by adhesive or equivalent and the fixing string 60 passes through the hollow tube 81 to achieve the purpose of fixing the fixing string 60 on the side plate 30 in which the fixing string 60 can move freely in the axial direction.

Figure 11A:
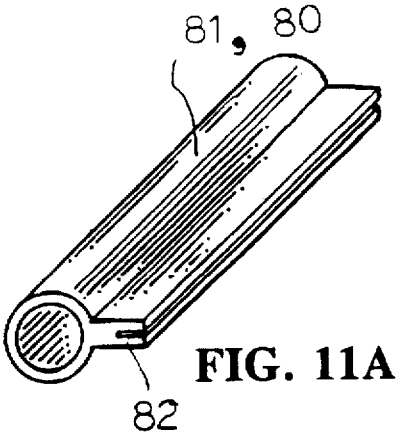
FIG. 11. Developed plane view drawing of Example 5 of the box cover of the present invention.
Figure 11B:
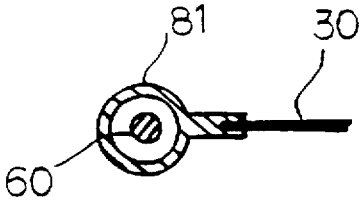
Figure 11:
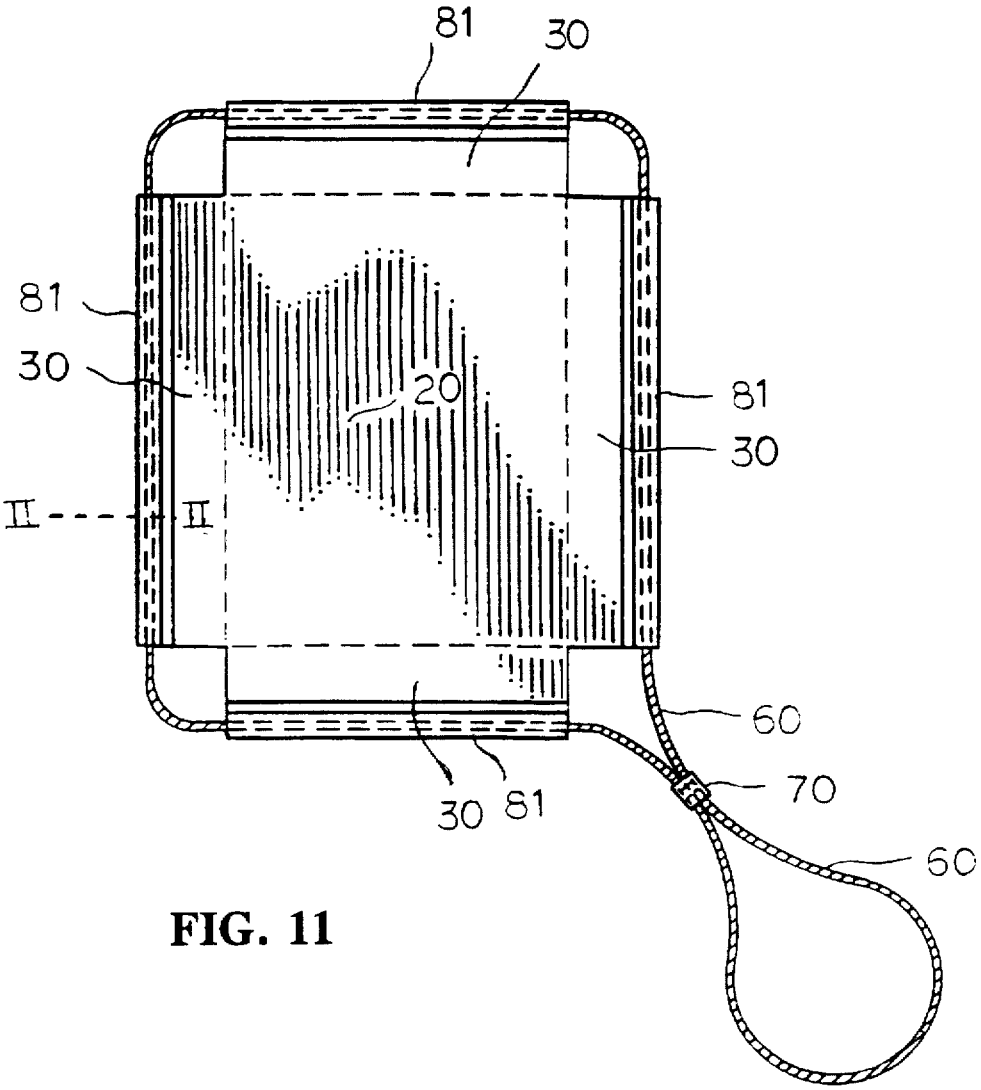

Or as shown in FIG. 11, the hollow tube 81 in Example 5 of the box cover of the present invention comprises a scoop channel 82 (see FIG. 11-A) in which the scoop channel matches the thickness of the side plate 30 so that the hollow tube 81 is tightly fixed on the side plate 30 through the scoop channel 82 (see FIG. 11-B) in order to achieve fixation of the fixing string 60 on the side plate 30 in which the fixing string 60 can move freely in the axial direction.

Figure 12:
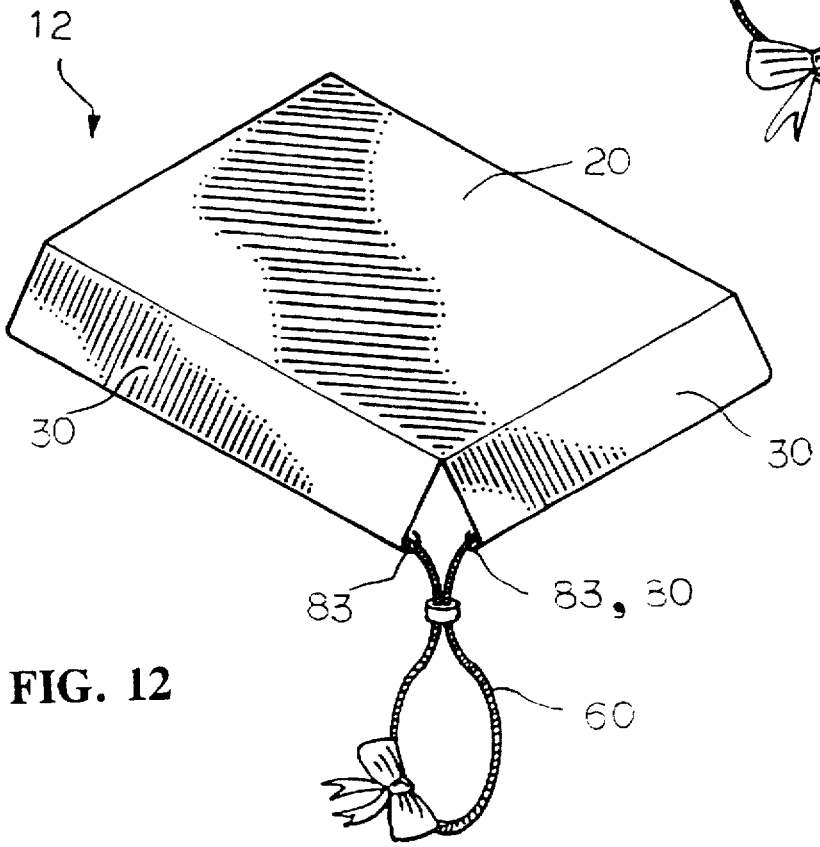
FIG. 12. Pictorial drawing of Example 6 box cover of the present invention.

FIG. 12 is the pictorial drawing of Example 6 box cover of the present invention. In which the outer edge 36 of the side plate 30 is formed into a hook 83. (The hook 83 shown in the figure was bent inward to the box cover 12; however, it can also be bent outward from the box cover 12.) The fixing string 60 goes through the hook 83 (fixing device 80) and will not detach from the gap of the hook 83 so that the fixing string 60 is fixed on the side plate 30 and the fixing string 60 can move freely in the axial direction.

FIG. 13 is the pictorial drawing of Example 7 box cover of the present invention. In which the fixing device 80 is a buckle 84 which is clamped in an appropriate position on each side plate 30. (If the box cover 12 is made of plastic material, the buckle 84 and the side plate 30 can also be formed integrally.) The fixing string 60 goes through the gap of the buckle 84 so that the fixing string 60 is fixed on the side plate 30 and the fixing string 60 can move freely in the axial direction. As a matter of fact, in Examples 4 and 5, if the length of the hollow tube 81 is not approximately equal to the length 34 of side plate and instead the hollow tube 81 is shorter, the idea of Example 7 can be applied as well. In such a case, multiple shorter hollow tubes 81 can be fixed at appropriate positions on each side plate 30.

FIG. 14 is the pictorial drawing of Example 8 box cover of the present invention. In which the fixing device 80 is a through channel 85 directly installed at appropriate position on the side plate 30 which penetrates the side plate in the length direction so that the fixing string 60 is fixed on the side plate 30 and the fixing string 60 can move freely in the axial direction.

Figure 6:
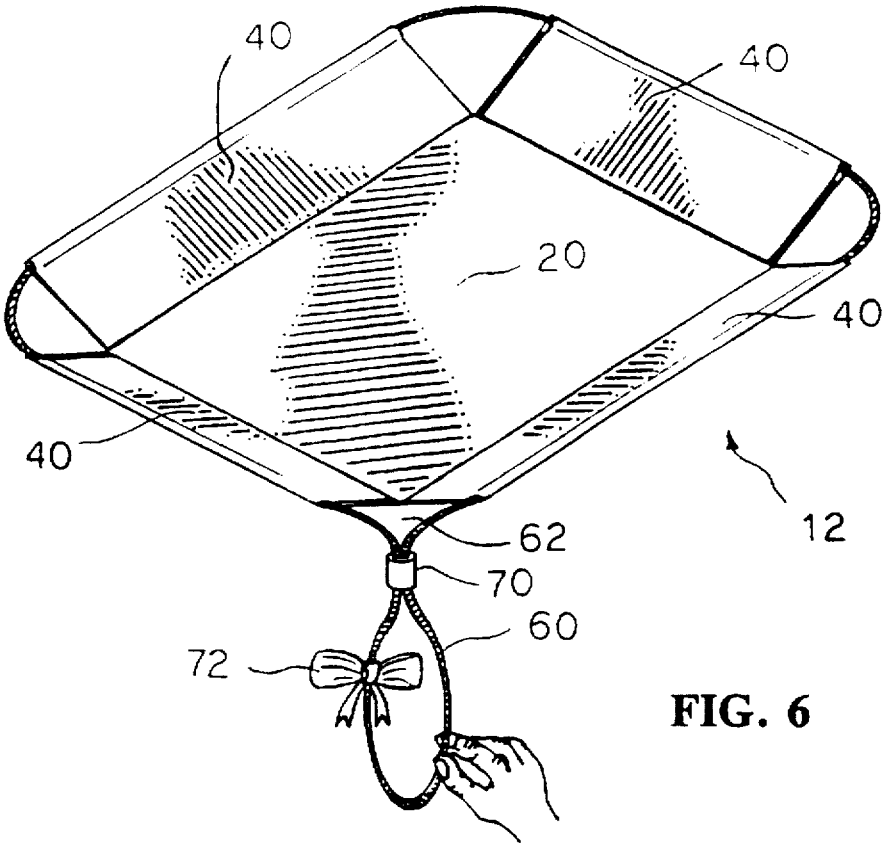
FIG. 6. Intermediate status view of the tridimensional box cover assembled from the planar box cover of the present invention.

Although the fixing devices 80 in the Examples listed herein before are slightly different, their focus is that the fixing string 60 can be fixed on the side plate 30 and the fixing string 60 can move freely in the axial direction for the convenience of use during assembly. The procedure and method of assembly in the Examples listed herein before, however, are the same. Take Example 1 as an example, as shown in FIG. 6, during assembly of the box cover 12, since the fixing string can move freely in the axial direction, the user only requires to pull the fixing string 60 outward at the outlet point 62 of the fixing string 60 so that the planar box cover 12 can be assembled into a tridimensional box cover 12 (as shown in FIG. 7). Meanwhile, optionally a retainer ring 70 with fastening function can be used to fix the fixing string 60 at the outlet point 62 or a knot can be tied at the outlet point 62 or the above operations are not performed.

Figure 8:
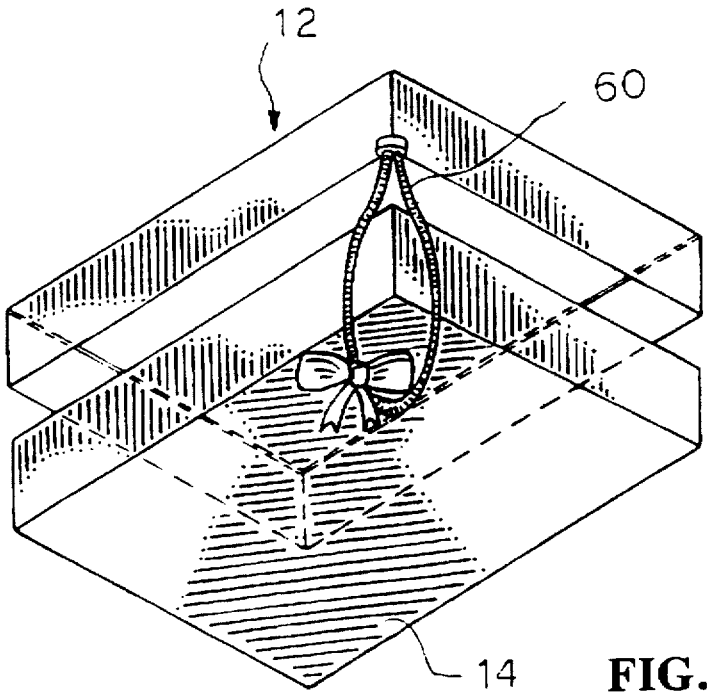
FIG. 8. Intermediate status view of the assembled box cover of the present invention and the second box cover.
Figure 9:
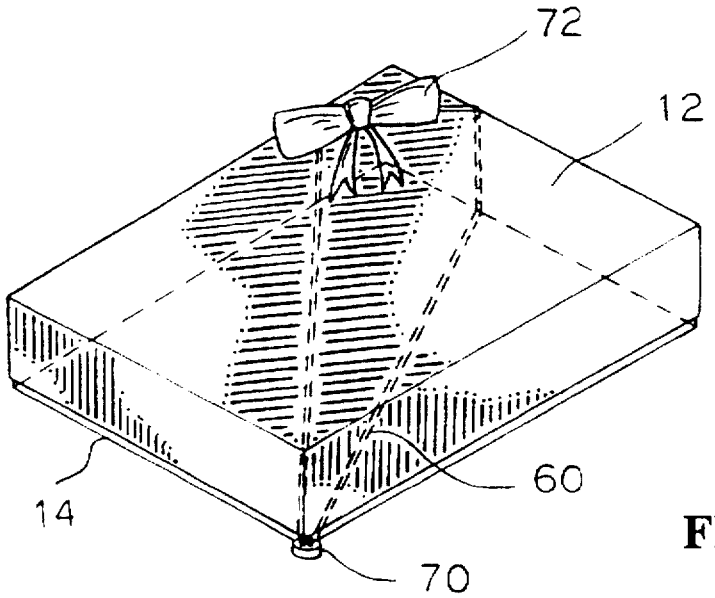
FIG. 9. Pictorial drawing of assembled box cover of the present invention and the second box cover.

After assembled into a tridimensional body, the box cover 12 can be matched with a second box cover 14, as shown in FIG. 8. When an elastic circular fixing string 60 was used, the user only requires to house the fixing string 60 on the second box cover 14 to complete the operation of assembly of the box 10 (as shown in FIG. 9). Of course, if a longer fixing string 60 was used, the means of fixing the box cover 12 with the second box cover 14 will be different from FIG. 8 and FIG. 9; and if the fixing string 60 is a longitudinal belt, the fixing string 60 can be used to tie up the box cover 12 and the second box cover 14 to form a tightly fixed box 10. Since such mode of using the fixing string 60 is prevalent among the people skilled in the art, its operation will not be elaborated further in this invention.

Furthermore, the second box cover 14 can also have the same design as the box cover 12 of this invention so that the user can promptly assemble the planar box cover 12 and the second box cover 14 in order to reduce the time spent on assembly.

Furthermore, the fixing string 60 can be combined with an embellishment 72 in advance at an appropriate position so that the user, such as a shopkeeper, can save the time required to install the embellishment 72. The assembly operation can follow the sequence of FIG. 6, FIG. 8, and FIG. 9 to promptly assemble the box cover 12, box 10 and embellishment 72.

The main technical idea of the present invention is related to providing at least one fixing string 60 in the box cover to achieve prompt assembly of the box cover, as well as using the fixing string to fix another combining box cover to promptly form a tightened box. Therefore, the scope of the present invention is not limited to the examples listed herein before. Changes on the geometry and number of the cover plate 20, side plate 30, attachment plate 40 of side plate, etc., using conventional box cover in combination with the fixing string 60 and the fixing device 80, or using different fixing device 80 to achieve fixing of the fixing string 60 on the side plate 30, and the fixing string can move freely in the axial direction, etc., are all without the scope of the present invention.

What is claimed is:

1. A box cover comprising:

a) a cover plate having a plurality of sides;

b) a plurality of side plates extending from the sides of the cover so as to enable the side plates to be folded relative to the cover plate;

c) a fixing string made of elastic material having a closed loop configuration; and d) a fixing device movably attaching the fixing string to each of the plurality of side plates wherein said fixing device further comprises;

an attachment plate extending from an outer edge of each of said side plates so as to enable the attachment plates to be folded over onto said side plate; and auxiliary attachment plates wherein each auxiliary attachment plate extends from outer edges of said attachment plates so as to enable said auxiliary attachment plates to be folded over onto said attachment plates, wherein said fixing string is located at the juncture betwen said attachment plate and said auxiliary attachment plate.

2. The box cover of claim 1, wherein a plurality of first fold lines are formed between said side plates and said cover plate; a plurality of second fold lines are formed between said attachment plates and said side plates; and a plurality of third fold lines are formed between said auxiliary attachment plates and said attachment plates.

3. The box cover of claim 1, wherein an indentation is formed between two adjacent attachment plates by making the length of one of said two adjacent attachment plates shorter than a length of the corresponding side plate.

4. A box cover according to claim 1, further comprising a retainer ring located on said fixing string.

5. A box cover according to claim 1 further comprising a decorative embellishment located on said fixing string.

6. A box cover comprising:

a) a cover plate having a plurality of sides;

b) a plurality of side plates extending from the sides of the cover so as to enable the side plates to be folded relative to the cover plate;

c) a fixing string made of elastic material having a closed loop configuration; and d) a fixing device movably attaching the fixing string to each of the plurality of side plates wherein said fixing device comprises a hollow tube adhesively fixed on each of said side plates wherein said fixing string passes through said hollow tubes.

7. The box cover of claim 6, wherein said hollow tube further comprises a channel corresponding in thickness to the thickness of said side plates so as to engage said side plates and tightly clamp said hollow tube to said side plates.

* * * * *